US006860471B2

(12) United States Patent
Albritton

(10) Patent No.: US 6,860,471 B2
(45) Date of Patent: Mar. 1, 2005

(54) FENCE DISPENSING APPARATUS

(76) Inventor: Samuel H. Albritton, 87 Sammy Jo Rd., Lumberton, MS (US) 39455

( * ) Notice: Subject to any disclaimer, the term of this patent is extended or adjusted under 35 U.S.C. 154(b) by 207 days.

(21) Appl. No.: 10/352,974

(22) Filed: Jan. 29, 2003

(65) Prior Publication Data

US 2004/0144965 A1 Jul. 29, 2004

(51) Int. Cl.[7] ..... B66D 1/00

(52) U.S. Cl. ..... 254/323; 242/557; 242/559.4; 242/594; 242/597.7; 242/403; 140/16; 140/37; 140/108

(58) Field of Search ..... 254/224–225, 254/323, 329, 383; 242/403, 557, 594, 594.3, 559.4, 597.7; 140/16, 27, 38, 107, 108

(56) References Cited

U.S. PATENT DOCUMENTS 2,789,778 A * 4/1957 Zogg et al. ..... 242/423.1
2,896,877 A * 7/1959 Vaughn ..... 242/557
2,914,270 A * 11/1959 Parker et al. ..... 242/390.7
3,048,348 A * 8/1962 Griffin ..... 242/422.5
3,570,731 A * 3/1971 Waltz ..... 225/38
3,934,655 A * 1/1976 Whistle ..... 173/46
4,473,196 A * 9/1984 Sammann et al. ..... 242/390.5
4,854,521 A * 8/1989 Farnsworth ..... 242/419.9
5,042,737 A * 8/1991 Sigle et al. ..... 242/423.1
5,582,216 A * 12/1996 Smith et al. ..... 140/107
5,632,470 A * 5/1997 Leland ..... 254/385
6,042,046 A * 3/2000 Beyer, Sr. ..... 242/559.1
D422,196 S * 4/2000 Hughes ..... D8/358
6,283,454 B1 * 9/2001 Bricker ..... 254/323
6,360,984 B1 * 3/2002 England ..... 242/557
6,419,182 B1 * 7/2002 Jansky ..... 242/557

* cited by examiner

*Primary Examiner*—Emmanuel Marcelo
(74) *Attorney, Agent, or Firm*—Wiley Hollopeter

(57) ABSTRACT

A fence dispensing apparatus for installing fencing wire along a line of fence posts. The fence dispensing apparatus permits easy setup along with efficient and safe operation. In addition to dispensing wire, the apparatus stretches unrolled wire using a winch and a wire interface. The fence dispensing apparatus essentially comprises a base member that sits on an axle and wheels. Moreover, the base member connects to a motor vehicle via a hitch receiver or a three-point tractor hookup. As the vehicle travels along a fence line, the apparatus dispenses wire from a vertically aligned spindle and/or from a horizontally aligned roller. The spindle disconnects from the base member, permitting it to be easily loaded with wire and set up for operation. Additionally, a spindle lock and spindle support act in concert to safely hold the loaded spindle in position. Furthermore, a wear plate between the loaded spindle and the base member protects the base member from excessive wear during operation. In addition to the spindle, a horizontally aligned roller dispenses wire. The horizontal roller includes a safety plate that protects against injury if the unrolled wire breaks and backlashes. Unrolled wire may be connected to a wire interface, permitting the unrolled wire to be associated to a cable without cutting the wire. Turning the apparatus' winch reels in the cable, stretching the unrolled wire.

19 Claims, 6 Drawing Sheets

FENCE DISPENSING APPARATUS

BACKGROUND OF THE INVENTION

1. Field of the Invention

The present invention relates to a fence dispensing apparatus for use in connection with installing fencing wire along a line of fence posts. The fence dispensing apparatus has particular utility in connection with promoting safe and efficient unrolling of fencing wire. The fence dispensing apparatus has further utility in permitting fast and easy setup for operation. Additionally, the apparatus stretches unrolled fence.

2. Description of the Prior Art

Fence dispensing apparatuses facilitate unrolling of fencing wire along a line of fence posts. In fact, the fence installing art is crowded with various apparatuses that dispense fencing wire. However, the existing fence dispensing apparatuses are difficult to set up, lack sufficient safety features, and operate inefficiently. Additionally, the existing apparatuses inefficiently stretch unrolled wire.

For example, U.S. Pat. No. 5,476,234 to Bertin J. St. Pierre discloses a vehicle-mounted wire dispensing apparatus. However, the St. Pierre '234 patent does not disclose a wire dispensing apparatus that is easy to set up, and has a further drawback of operating inefficiently. More specifically, the St. Pierre apparatus requires its user to lift a wire roll several feet in order to load it on a spindle. This is a major drawback as wire rolls often weigh up to five hundred pounds. Additionally, the wire sits on a base plate that experiences excessive wear as the wire unrolls from the spindle. Because the spindle is welded to the base plate, a worn base plate is both difficult and expensive to replace.

Similarly, U.S. Pat. No. 5,582,216 to Michael T. Smith and Barry K. Cole discloses an apparatus for installing fencing wire. However, the Smith '216 patent lacks a surface between the ground and its separator plates. This is a drawback because fences are often erected in fields containing loose brush and debris. Loose brush and debris may entangle themselves in the rolled wire, impeding the wire from dispensing efficiently. Moreover, the dispensing operation must be stopped to remove loose brush or impediments from the wire roll.

Lastly, U.S. Pat. No. 6,419,182 to Jimmy Jansky discloses a wire dispensing unit that operates unsafely and inefficiently. The Jansky '182 patent does not permit a roll of wire to be secured to the apparatus, thus it cannot properly insure that wire stays on its spindle as it unrolls. This is a safety concern because the wire may injure someone if it ejects from the dispensing unit. Furthermore, this is an efficiency concern because it takes time to reload the wire roll each time it ejects from the spindle. Additionally, none of the aforementioned apparatuses efficiently stretch unrolled wire.

While the above-described devices fulfill their respective, particular objectives and requirements, the aforementioned patents do not describe a fence dispensing apparatus that allows easy loading and safe, efficient operation. The St. Pierre '234 patent makes no provision for loading wire on the spindle without lifting the heavy wire over the top of the spindle. In other words, setting up the St. Pierre apparatus is both dangerous and time consuming. The Smith '216 patent makes no provision for keeping the rolled wire free from obstructions. This is a drawback because obstructions may entangle themselves in the rolled wire, impeding the wire from dispensing efficiently. The Jansky '182 patent makes no provision for securing its load. The Jansky apparatus is unsafe because a wire roll may eject itself and harm someone. Moreover, having to stop and reload a wire roll each time it ejects is inefficient.

Therefore, a need exists for a new and improved fence dispensing apparatus that permits easy loading and safe, efficient operation. In this regard, the present invention substantially fulfills this need. In this respect, the fence dispensing apparatus according to the present invention substantially departs from the conventional concepts and designs of the prior art, and in doing so provides an apparatus primarily developed for the purpose of permitting safe and efficient unrolling of fencing wire along a line of fence posts. Additionally, the apparatus was developed for the purpose of allowing fast and easy setup for operation.

SUMMARY OF THE INVENTION

In view of the foregoing disadvantages inherent in the known types of fence dispensing apparatuses now present in the prior art, the present invention provides an improved fence dispensing apparatus, and overcomes the above-mentioned disadvantages and drawbacks of the prior art. As such, the general purpose of the present invention, which will be described subsequently in greater detail, is to provide a new and improved fence dispensing apparatus which has all the advantages of the prior art mentioned heretofore and many novel features that result in a fence dispensing apparatus which is not anticipated, rendered obvious, suggested, or even implied by the prior art, either alone or in any combination thereof To attain this, the present invention essentially comprises a rectangular-shaped base member resting on an axle and two wheels. A pair of plates extends vertically from the base member near the wheels. More particularly, one plate is located near each wheel. Each plate has an aperture that is shaped and dimensioned for reception of a pin. The plates and pins are positioned to facilitate a three-point hookup for connecting the base plate to a tractor. Additionally, an extension from the front end of the base member connects the base member to a conventional trailer hitch receptacle. Moreover, the extension is adjustable for use in connection with the three-point tractor hookup. Therefore, the fence dispensing apparatus may be pulled behind a tractor, truck, or other motor vehicle.

In addition to the base member, the fence dispensing apparatus comprises components that permit fencing wire to be dispensed vertically and/or horizontally. Vertical operation is achieved through interaction of a spindle receptacle, a wear plate, a spindle, a spindle lock, and a spindle support. The spindle receptacle is fixed to the top of the base member. Additionally, a bore extends through the spindle receptacle. The circular-shaped wear plate has an aperture located at its center that is shaped and dimensioned for reception of the spindle receptacle. The wear plate is bolted to the base member with the spindle receptacle extending through its aperture.

The spindle is an elongated member having one end that is shaped and dimensioned for slidable insertion into the spindle receptacle's bore. The spindle lock extends perpendicularly from the opposite end of the spindle. Furthermore, the spindle lock has an aperture opposite the spindle that lies in a plane perpendicular to the spindle.

The spindle support extends vertically from the base member between the wear plate and the base member's front end. A spindle securing plate is hingedly attached to the spindle support opposite the base member. Moreover, the spindle securing plate has an aperture opposite the spindle support. When the spindle is inserted into the spindle receptacle the spindle lock's aperture aligns with the spindle securing plate's aperture. Furthermore, a bolt translates through the spindle lock's aperture and the spindle securing plate's aperture. After the bolt is inserted through the apertures, a nut threads on to the bolt, locking the spindle to the spindle securing plate. Removing the nut and bolt unlocks the spindle from the spindle securing plate.

In addition to vertical operation, the fence dispensing apparatus is capable of dispensing fence horizontally. Horizontal operation is achieved through interaction of a roller support, a roller securing assembly, a roller, a safety plate, a chain hook, and a stabilizer chain. The roller support has a square pipe shape and is fixed to the base member. More particularly, the roller support extends vertically from the base member.

Like the roller support, the roller securing assembly has a square pipe shape. A bore extends through the roller securing assembly, allowing the roller securing assembly to slide over the roller support. A threaded bolt screws into a complementarily threaded bolt receptacle in the roller securing assembly, exerting a clamping pressure on the roller support when the roller securing assembly is positioned at a selected height along the roller support. In other words, the bolt clamps the roller securing assembly to the roller support.

The roller has a pipe shape with an inner plate attached to one end. The roller securing assembly is attached to the inner plate opposite the roller. Furthermore, the end of the roller opposite the inner plate defines a bolt receptacle. The bolt receptacle is shaped and dimensioned for reception of a threaded bolt. The inner plate further comprises a notch formed in its perimeter. Moreover, the notch is located at the top of the inner plate.

An outer plate is removably attached to the roller opposite the inner plate by directing a bolt through the outer plate and into the roller's bolt receptacle. Prior to bolting the outer plate to the roller, a rod is inserted into the inner plate's notch. The rod runs parallel to the roller, extending past the roller's second end. Additionally, the outer plate has a rod receptacle extending from its perimeter. The outer plate's rod receptacle is shaped and dimensioned for reception of the rod. Therefore, when the outer plate is bolted to the roller, the rod receptacle receives and supports the rod.

The safety plate is a rectangular plate with a curved surface. The top of the safety plate is hingedly attached to the rod. Moreover, the curved portion of the safety plate extends from the rod toward the back end of the base member. More particularly, the safety plate curves downward toward the base member. In other words, the safety plate covers wire that is loaded on the roller. In this manner, the safety plate acts a gravity break to prevent injury if the wire breaks and back lashes.

The chain hook is fixed to the base member between the roller support and the base member's first end. The stabilizer chain is attached to the chain hook at one end. The opposite end of the stabilizer chain is fixed to a turnbuckle. Moreover, the turnbuckle is fixed to the roller securing assembly.

In addition to dispensing wire vertically and horizontally, the fence dispensing apparatus of the present invention stretches unrolled wire. The apparatus stretches unrolled wire using a winch and a wire interface. Furthermore, a cable attaches to the winch in a manner that permits it to unroll from, and back onto, the winch when the winch turns. A hook is attached to the opposite end of the cable.

The winch is fixed to a winch securing assembly that has a square pipe shape. A bore extends through the winch securing assembly, allowing the winch securing assembly to slide over the roller support. A threaded bolt screws into a complementarily threaded hole in the winch securing assembly, exerting a clamping pressure on the roller support when the winch securing assembly is positioned at a selected height along the roller support. In other words, the bolt clamps the winch securing assembly to the roller support.

The wire interface has a figure eight shape with a whole loop on one end and a semi loop on the opposite end. Additionally, two notches are formed between the two loops. The whole loop is shaped and dimensioned for reception of the winch's hook. The notches are shaped and dimensioned for reception of conventional barbed wire. More particularly, wire is connected to the wire interface by sliding it in the first notch from one direction and sliding it in the second notch from the opposite direction.

There has thus been outlined, rather broadly, the more important features of the invention in order that the detailed description thereof that follows may be better understood and in order that the present contribution to the art may be better appreciated. The invention may also include additional components for dispensing wire with multiple spindles or multiple rollers. In other words, more than one roller securing assembly may be mounted on the roller support. Additionally, more than one roller support may be fixed to the base member. Similarly, more than one spindle receptacle and spindle support may be fixed to the base member for reception of additional spindles. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved fence dispensing apparatus that has all of the advantages of the prior art fence dispensing apparatuses and none of the disadvantages.

It is another object of the present invention to provide a new and improved fence dispensing apparatus that may be easily and efficiently manufactured and marketed.

Another object of the present invention is to provide a fence dispensing apparatus that may be easily loaded with fencing wire.

Still another object of the present invention is to provide a fence dispensing apparatus that incorporates new and improved safety features.

It is another object of the present invention to provide a new and improved fence dispensing apparatus that improves the overall efficiency in which wire is dispensed by an apparatus pulled behind a vehicle.

Furthermore, it is an object of the present invention to provide a fence dispensing apparatus that has a replaceable wear plate. The wear plate protects the base member from excessive wear as the fence unrolls from the spindle, making the apparatus more durable.

Lastly, it is an object of the present invention to provide a fence dispensing apparatus that improves the overall efficiency in which unrolled wire is stretched.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
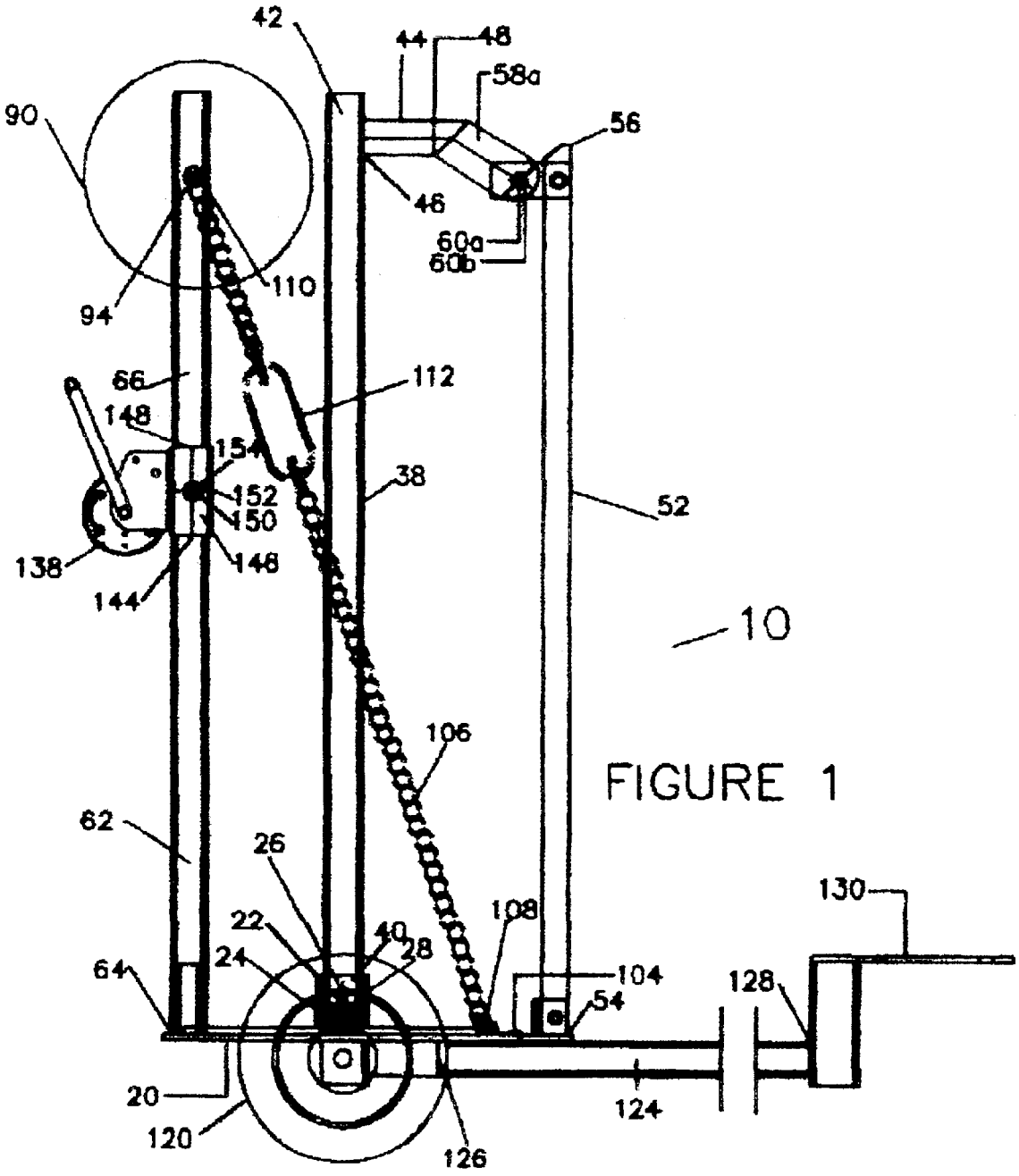
FIG. 1 is a left side view of the preferred embodiment of the fence dispensing apparatus constructed in accordance with the principles of the present invention.

Referring now to the drawings, and particularly to FIGS. 1–6, a preferred embodiment of the fence dispensing apparatus of the present invention is shown and generally designated by the reference numeral 10.

In FIG. 1, a new and improved fence dispensing apparatus 10 of the present invention for easily, efficiently, and safely dispensing fencing wire along a line of fence posts is illustrated and will be described. More particularly, the fence dispensing apparatus 10 has a base member 12 that functions as the fence dispensing apparatus' main body and support. The base member 12 further comprises a front end 14, a back end 16, a top surface 18, and a bottom surface 20. The front end 14 moves forward down a line of fence posts while wire unrolls off the back end 16. In the preferred embodiment, the base member 12 has a rectangular shape.

A spindle receptacle 22 is fixed to the base member 12, extending perpendicularly from the top surface 18. Additionally, the spindle receptacle 22 comprises an exterior surface 24 and an interior surface 26. The interior surface 26 defines a bore 28 that extends through the spindle receptacle 22.

Figure 2:
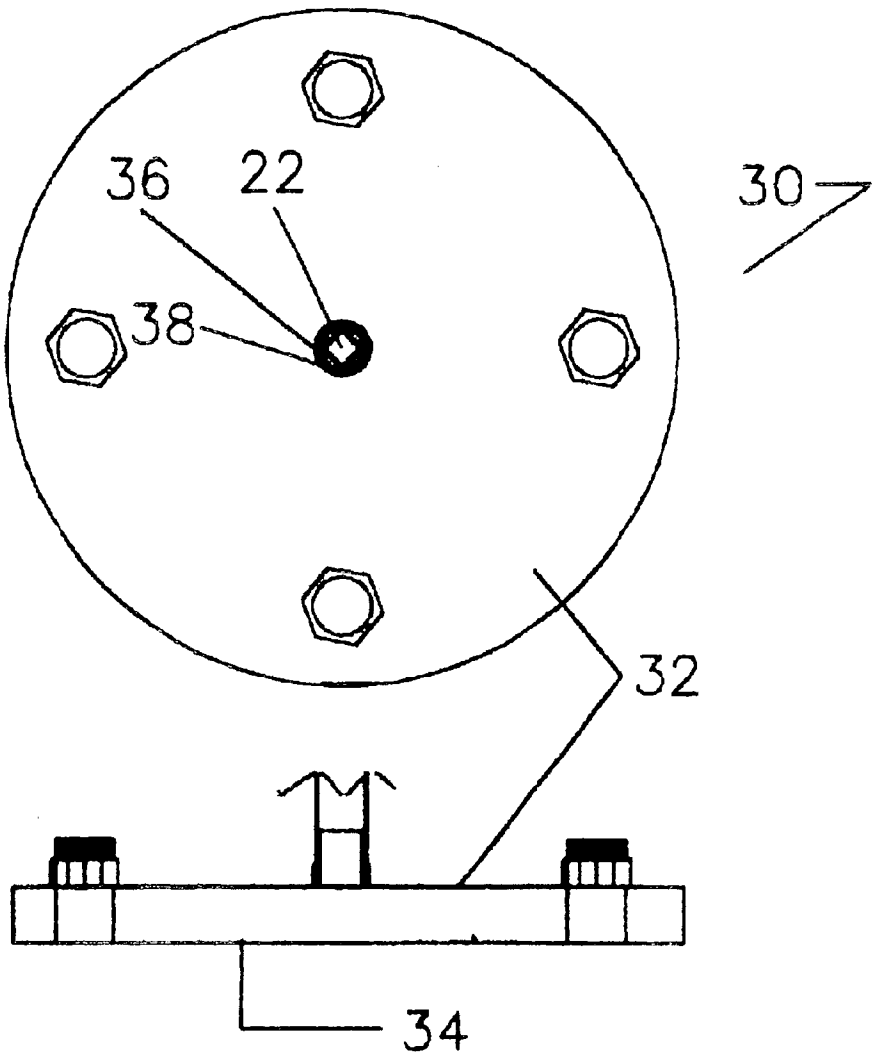
FIG. 2 is a top plan view of the fence dispensing apparatus' wear plate.
Figure 3:
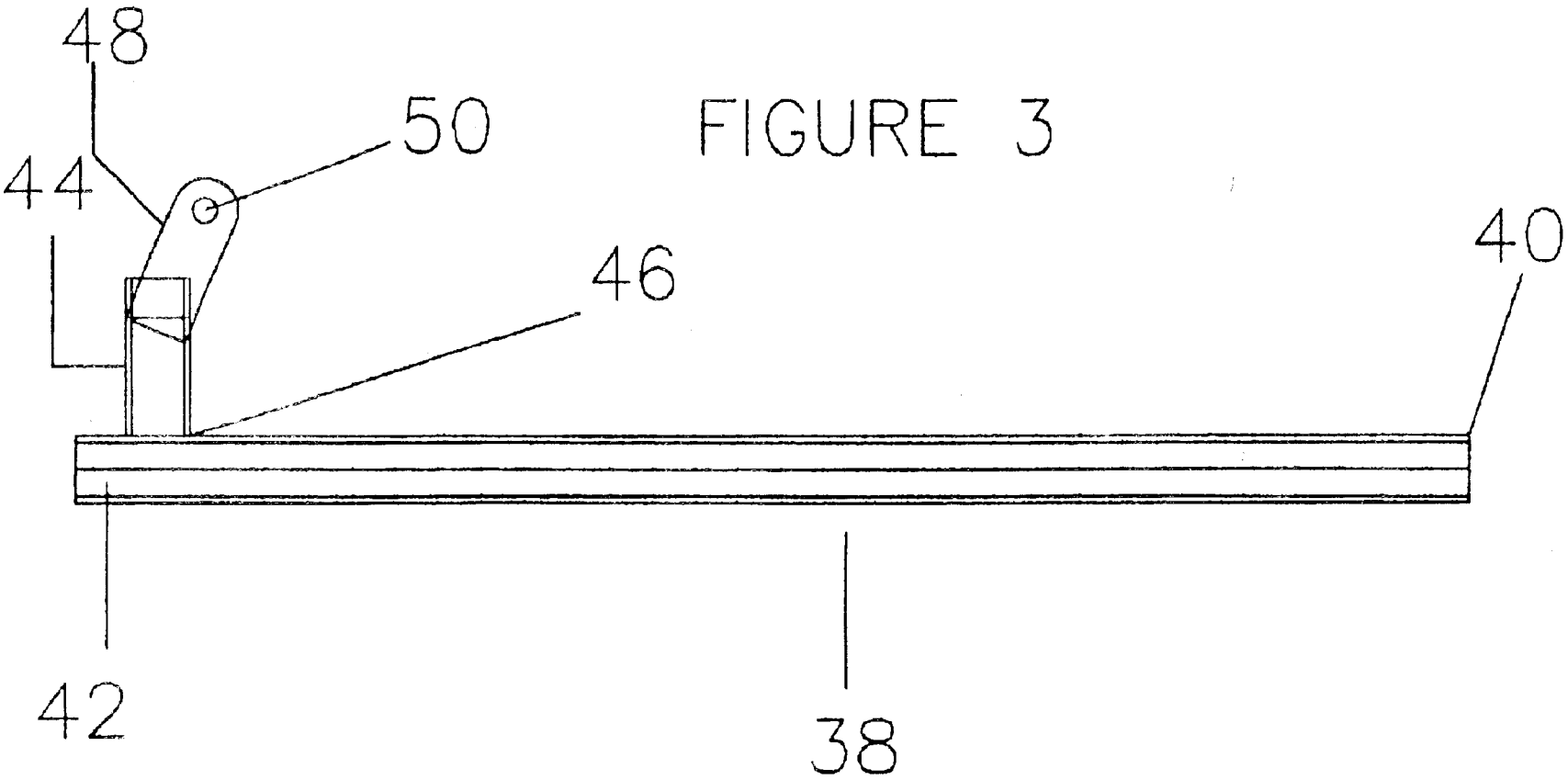
FIG. 3 is a left side view of the fence dispensing apparatus' spindle.

The fence dispensing apparatus 10 further comprises a wear plate 30. As shown in FIG. 2, the wear plate 30 has a top surface 32 and bottom surface 34. Furthermore, the wear plate 30 defines an aperture 36 through its center. The wear plate's aperture 36 is shaped and dimensioned for reception of the spindle receptacle 22. More particularly, the wear plate's bottom surface 34 sits on the base member's top surface 18 with the spindle receptacle 22 extending through its aperture 36. The wear plate 30 protects the base member 12 from excessive wear as wire unrolls from the wire dispensing apparatus 10. In the preferred embodiment, the wear plate 30 is bolted to the base member 12 with a plurality of bolts. Accordingly, the wear plate 30 is easily removed and replaced.

FIG. 1 further illustrates the fence dispensing apparatus' spindle 38. The spindle 38 comprises an elongated shape having a first end 40, a second end 42, and a spindle lock 44. More particularly, the spindle's first end 40 is shaped and dimensioned for slidable insertion into the spindle receptacle's bore 28. In other words, the spindle receptacle 28 positions the spindle's first end 40 and holds it in place. In the preferred embodiment, the spindle 38 is a four-foot pipe. Alternatively, the spindle 38 may be shorter or longer for dispensing various fence sizes.

The spindle lock 44 further comprises a first end 46, a second end 48, and an aperture 50. The spindle lock's first end 46 is fixed to the spindle's second end 42 and extends horizontally from the vertically positioned spindle 38. Furthermore, the spindle lock's second end 48 defines an aperture 50 therein. The spindle lock's aperture 50 lays in a plane that is perpendicular to the spindle 38.

In association with the spindle 38, the fence dispensing apparatus 10 further comprises a spindle support 52. The spindle support 52 has a first end 54 and a second end 56. More specifically, the spindle support's first end 54 is fixed to the base member's top surface 18 between the wear plate 30 and the base member's front end 14. A spindle securing plate **58*a* is rotatably attached to the spindle support's second end 56. Furthermore, the spindle securing plate defines an aperture 58*b* opposite said spindle support 52**.

In use, the spindle 38 is slid into the center of a roll of fence. Next, the spindle 38 is loaded onto the fence dispensing apparatus 10 by inserting its first end 40 into the spindle receptacle 22. When the spindle 38 is positioned in the spindle receptacle 22, the spindle lock's aperture 50 aligns with the spindle securing plate's aperture **58*b*. The spindle securing plate 58*a* rotates on the spindle support 52, permitting the spindle securing plate 58*a* to align with the spindle lock 44 when the spindle 38** is lengthened or shortened.

A bolt **60*a* is directed through the spindle lock's aperture 50 and the spindle securing plate's aperture 58*b*. A nut 60*b* threads onto the bolt 60*a*, locking the spindle 38 to the spindle securing plate 58*a*. Removing the nut 60*b* and bolt 60*a* unlocks the spindle 38 from the spindle securing plate 58*a*. As a motor vehicle pulls the fence dispensing apparatus forward, fencing wire unrolls from the spindle 38 and off the apparatus' back end 16**.

FIG. 1 further illustrates the fence dispensing apparatus' roller support 62. The roller support 62 has an elongated square shape comprising a first end 64 and a second end 66. Furthermore, the roller support's first end 64 is fixed to the base member's top surface 18. The roller support 62 extends vertically from the base member 12 to its second end 66.

Figure 4:
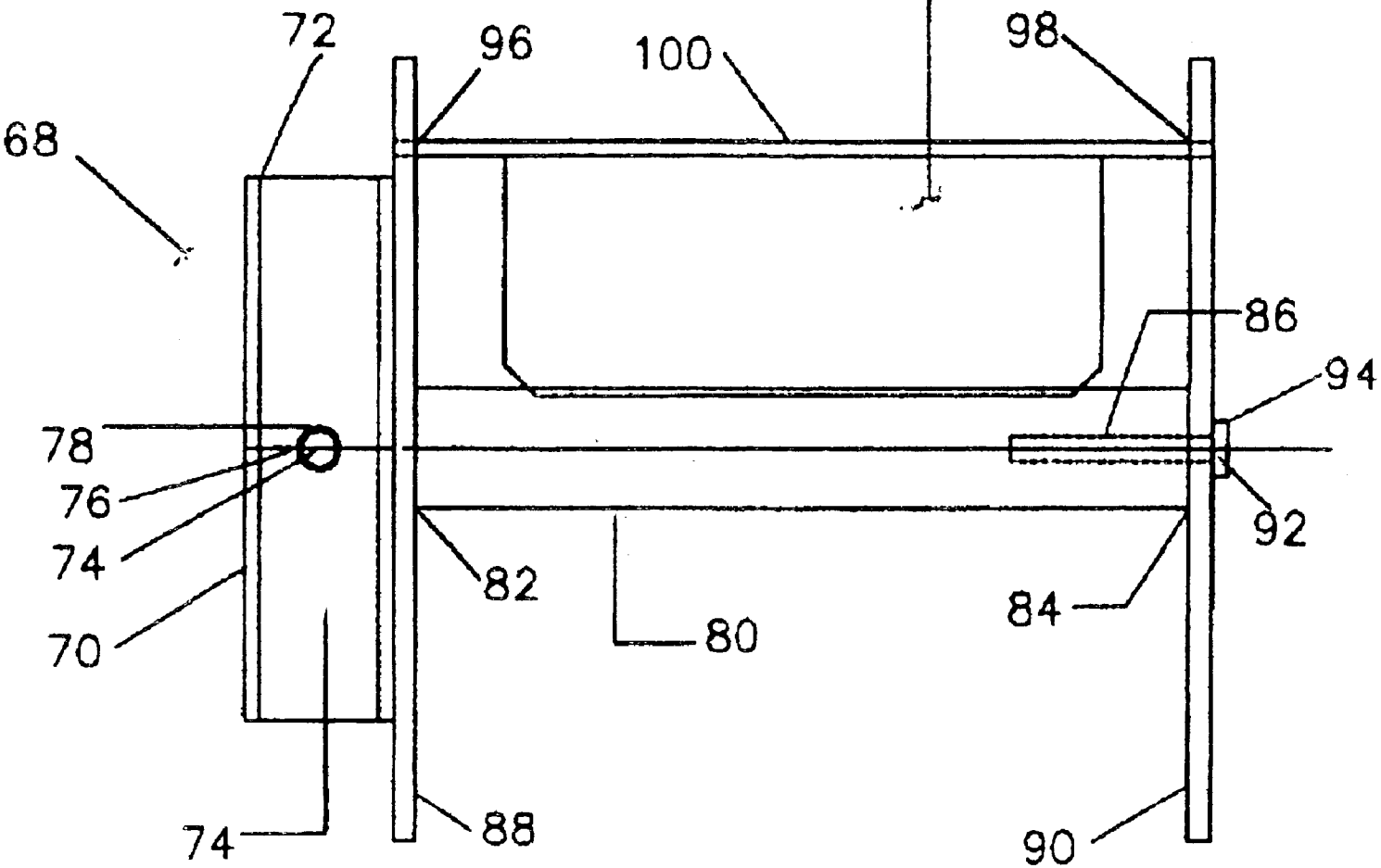
FIG. 4 is a front side view of the fence dispensing apparatus's roller securing assembly and roller.

In association with the roller support 62, the fence dispensing apparatus further comprises a roller securing assembly 68 and a roller 80. FIG. 4 further illustrates the roller securing assembly 68 and roller 80. The roller securing assembly 68 is square-shaped pipe with an exterior surface 70 and an interior surface 72. Moreover, the interior surface 72 defines a bore 74 that extends through the roller securing assembly 68. The bore 74 is shaped and dimensioned for slidable reception of the roller support 62. A threaded bolt 76 screws into a complementarily bolt receptacle 78 in the roller securing assembly 68. Tightening the bolt 76 exerts a clamping pressure on the roller support 62, securing the roller securing assembly 68 to the roller support 62. Loosening the bolt 76 releases the clamping pressure on the roller support 62, permitting the roller securing assembly 68 to be repositioned on the roller support 62.

As shown in FIG. 4, the roller 80 has a pipe shape with a first end 82 and a second end 84. Additionally, the roller's second end 84 defines a bolt receptacle 86 therein. A circular-shaped inner plate 88 is fixed to the roller's first end 82. Furthermore, the roller securing assembly 68 is fixed to the inner plate 88 opposite the roller 80. A circular-shaped outer plate 90 removably attaches to the roller's second end 84. More particularly, the outer plate 90 defines and aperture 92 through its center. A bolt 94 is directed through the outer plate's aperture 92 and into the roller's bolt receptacle 86. The bolt 94 secures the outer plate 90 to the roller 80.

In addition to connecting the roller 80 and the roller securing assembly 68, the inner plate 88 defines a notch 96 located between its center and perimeter. More specifically, the notch 96 is positioned at the top of the inner plate 88 immediately inside its perimeter. Additionally, the outer plate 90 defines a rod receptacle 98 on its perimeter. Before securing the outer plate 90 to the roller 80 the rod receptacle 98 is aligned on the same plane with the inner plate's notch 96. A rod 100 slides in the inner plate's notch 96 and extends past the rod receptacle 98 running parallel to the roller 80.

A safety plate 102 is hingedly attached to the rod 100. The safety plate 102 is a rectangular plate with a curved surface. Furthermore, the curved portion of the safety plate 102 extends from the rod 100 toward the base member's back end 16. More particularly, the safety plate 102 curves downward toward the base member 12. In other words, the safety plate 102 covers wire that is loaded on the roller 80. In this manner, the safety plate 102 acts a gravity break to prevent injury if the wire breaks and backlashes.

Referring back to FIG. 1, the fence dispensing apparatus 10 further comprises a chain hook 104 and stabilizer chain 106. The chain hook 104 is fixed to the base member's top surface 18 between the roller support 62 and the base member's front end 14. The stabilizer chain 106 has a first end 108 and a second end 110. The stabilizer chain's first end 108 is fixed to the chain hook 104. On the other hand, the stabilizer chain's second end 110 is fixed to a turnbuckle 112. Furthermore, turnbuckle 112 is fixed to the roller securing assembly 68. The stabilizer chain 106 bolsters the roller support 62, counterbalancing the force from unrolled wire.

In use, the roller securing assembly 68 is positioned on the roller support 62 at the desired height. A bolt 76 screws into a bolt receptacle 78 in the roller securing assembly 68, securing the roller securing assembly 68 to the roller support 62. Next, a roll of wire is loaded on the roller 80. After loading the wire on the roller 80, the rod 100 is inserted into the inner plate's notch 96. Then the outer plate 90 is secured to the roller's second end 80 so that the rod 100 extends through the outer plate's rod receptacle 98. The outer plate 90 holds the rolled wire on the roller 80. As the fence dispensing apparatus 10 is pulled forward, wire unrolls from the roller 80 and off the apparatus' back end 16.

Figure 5:
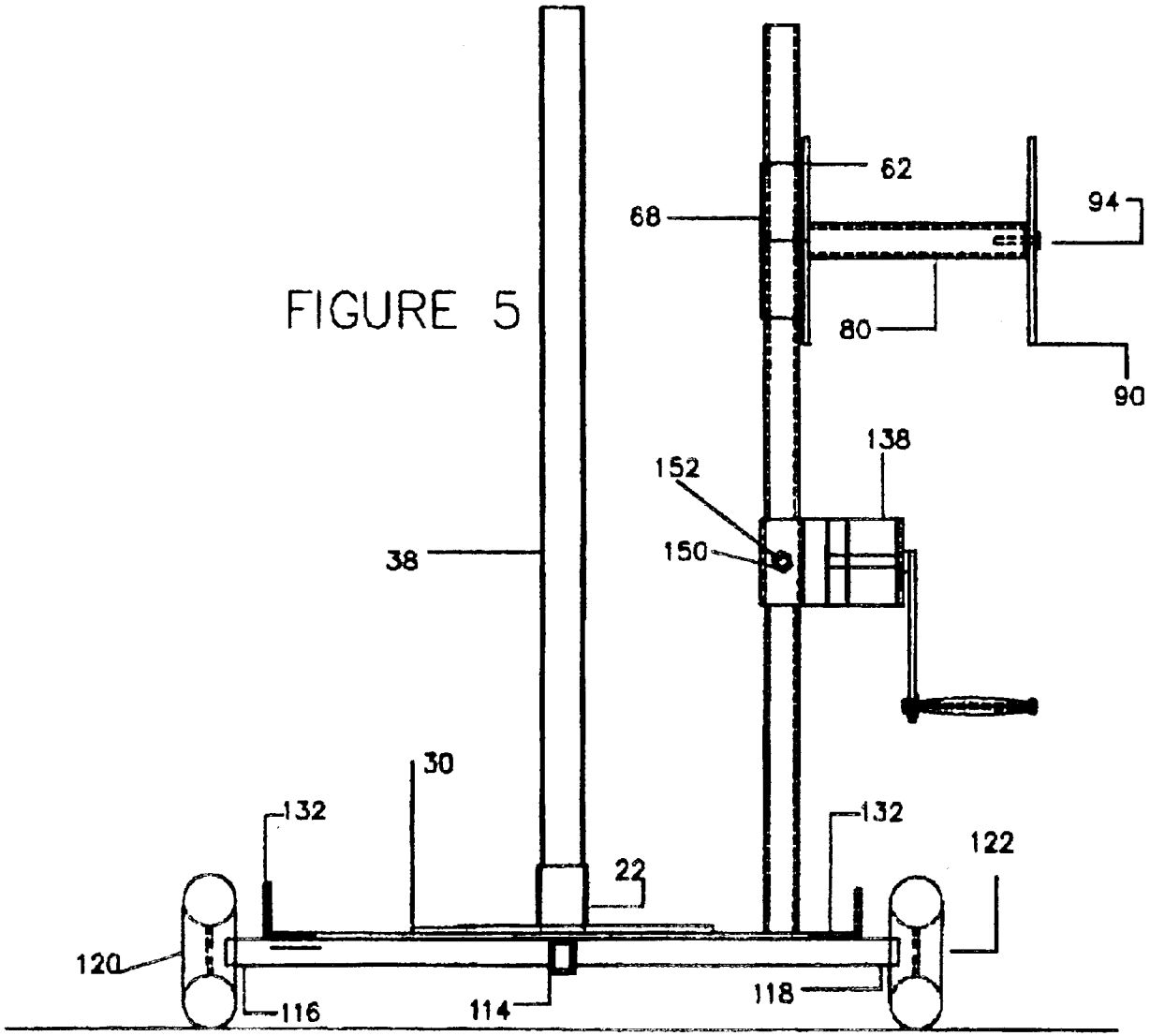
FIG. 5 is a back side view of the fence dispensing apparatus of the present invention.

FIG. 5 illustrates the fence dispensing apparatus' axle member 114. More particularly, the axle member 114 comprises a first end 116 and a second end 118. The axle member 114 is attached to the base member's bottom surface 20. A first wheel 120 is removably attached to the axle member's first end 116. Similarly, a second wheel 122 is removably attached to the axle member's second end 118. The axle member 114, first wheel 120, and second wheel 122 permit the fence dispensing apparatus 10 to roll.

Referring back to FIG. 1, the fence dispensing apparatus 10 further comprises a hitch extension 124. The hitch extension 124 has a first end 126, a second end 128, and a hitch receiver 130. More specifically, the hitch extension's first end 126 is fixed to the base member's front end 14. The hitch extension 124 extends horizontally from the base member 12 to its second end 1128. The hitch receiver 130 is integrally attached to the hitch extension's second end 128. Moreover, the hitch receiver 130 is shaped and dimensioned for reception of a typical ball type trailer hitch. Alternatively, the hitch receiver 130 may be shaped and dimensioned for reception of other trailer hitch styles. Additionally, the hitch extension 124 adjusts to permit a three-point tractor hookup.

A pair of plates 132 extends vertically from the base member 12. More particularly, one plate is located near each wheel, 120 and 122. Each plate 132 defines an aperture 134 that is shaped and dimensioned for reception of a pin 136. The plates 132 and pins 136 are positioned to facilitate a three-point hookup for connecting the base plate 12 to a tractor.

After the fence dispensing apparatus 10 dispenses the desired amount of wire, a winch 138 and wire interface 150 are utilized to stretch the unrolled wire. The winch 138 is similar to a conventional boat winch. Moreover, one end of a cable 140 is fixed to the winch 138 in a manner that permits the cable to be unrolled and rolled back onto the winch 138. The opposite end of the cable 140 is fixed to a hook 142. Furthermore, the winch 138 is fixed to a winch securing assembly 144.

The winch securing assembly 144 is a square-shaped pipe with an exterior surface 146 and an interior surface 148. Furthermore, the interior surface 148 defines a bore 150 that extends through the winch securing assembly 144. The bore 150 is shaped and dimensioned for slidable reception of the roller support 62. A threaded bolt 152 screws into a complementarily bolt receptacle 154 in the winch securing assembly 144. Tightening the bolt 152 exerts a clamping pressure on the roller support 62, securing the winch securing assembly 144 to the roller support 62. Loosening the bolt 152 releases the clamping pressure on the roller support 62, permitting the winch securing assembly 144 to be repositioned on the roller support 62.

Figure 6:
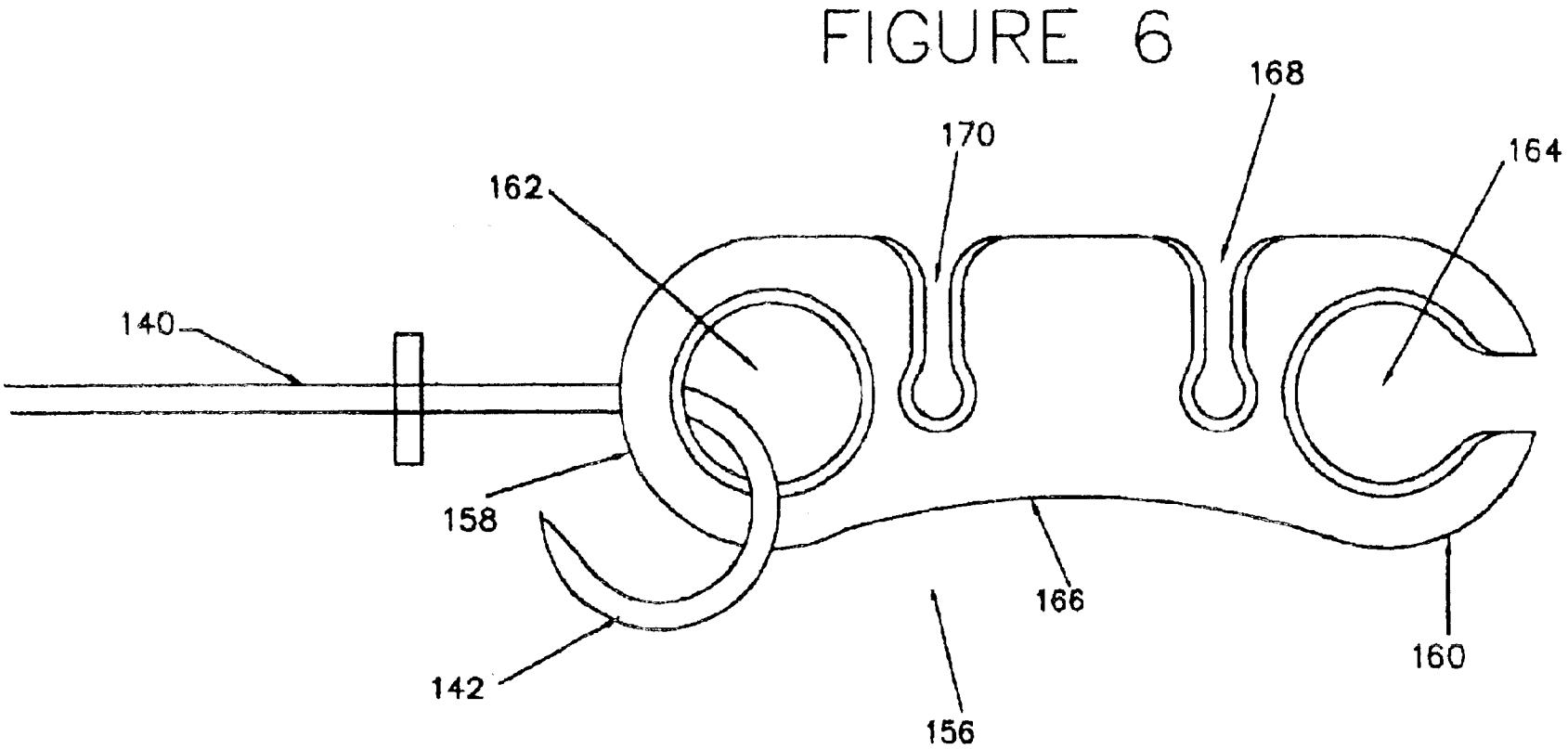
FIG. 6 is a top plan view of the wire interface. The same reference numerals refer to the same parts throughout the various figures.

The winch's hook 142 connects to a wire interface 156. FIG. 6 better illustrates the hook 142 and wire interface 156. The wire interface 156 has a figure eight shape. More particularly, the wire interface comprises a first end 158, a second end 160, a whole loop 162, a semi loop 164, and a bridge portion 166. The first end 158 is integrally attached to the whole loop 162. On the other hand, the second end 160 is integrally attached to the semi loop 162. The bridge portion 166 connects the first 158 and second 160 ends. Moreover, the bridge portion 166 defines a first notch 168 and a second notch 170.

In use, the hook 142 slides through the whole loop 162, associating the hook 142 and wire interface 156. In turn, the unrolled wire is connected to the wire interface 156 by sliding it through the first notch 162 in one direction and sliding it thorough the second notch 164 in the opposite direction. The advantage of connecting the wire to the wire interface 156 in this manner is that the unrolled wire may be stretched without cutting it loose from the rolled wire on the fence dispensing apparatus 10. Turning the winch 138 stretches the unrolled wire. In other words, turning the winch 138 retracts the cable 140 and hook 142. Retracting the cable 140 and hook 142 reels in the wire interface 156 and stretches the wire.

While a preferred embodiment of the fence dispensing apparatus has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, different combinations of rollers and spindles may be used to erect different fences. In other words, a plurality of rollers may be secured to the roller support so that multiple strands of wire are dispensed concurrently. Optionally, a plurality of roller supports may be fixed to the base member. This configuration would also permit multiple strands of wire to be dispensed concurrently. Similar configurations can be utilized by employing multiple spindles.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A fence dispensing apparatus comprising:

a base member having a front end, a back end, a top surface, and a bottom surface;

a spindle receptacle having an exterior surface and an interior surface, said interior surface defining a bore extending through said spindle receptacle, said spindle receptacle being fixed to said base member and extending perpendicularly from said base member's top surface;

a circular-shaped wear plate defining an aperture in the center thereof, said wear plate's aperture being shaped and dimensioned for slidable reception of said spindle receptacle; a plurality bolts directed through said wear plate and said base plate to removably couple the wear plate to the base plate;

an elongated spindle having a first end and a second end, said spindle's first end being shaped and dimensioned for slidable insertion into said spindle receptacle's bore;

a spindle lock having a first end and a second end, said first end being integrally attached to and extending perpendicularly from said spindle's second end, said spindle lock's second end defining an aperture lying in a plane perpendicular to said spindle;

a spindle support having a first end, a second end, said first end being fixed to and extending perpendicularly from said base member's top surface between said wear plate and said base member's front end;

a spindle securing plate having a first end and a second end, said spindle securing plate's first end being rotatably attached to said spindle support's second end, said spindle securing plate's second end defining an aperture lying in a plane perpendicular to said spindle support; a pin being shaped and dimensioned for removable translation through said spindle lock's aperture and said spindle securing plate's aperture;

a roller support having a first end and a second end, said first end being fixed to and extending perpendicularly from said base member's top surface;

a pipe-shaped roller having a first end, a second end, an inner plate, an outer plate, said inner plate being fixed to said roller's first end, said roller's second end defining a bolt receptacle therein, and said outer plate defining an aperture in its center; a bolt being shaped and dimensioned for threadable translation through said outer plate's aperture and into said roller's bolt receptacle;

a roller securing assembly having an exterior surface and an interior surface, said roller securing assembly being fixed to said roller's inner plate opposite said roller and defining a bolt receptacle, said interior surface defining a bore extending through said roller securing assembly, and said bore being shaped and dimensioned for slidable reception of said roller support; a bolt being shaped and dimensioned for threadable translation through said bolt receptacle; a turnbuckle, said turnbuckle having a first end fixed to said roller securing assembly;

a chain hook fixed to said base member's top surface between said roller support and said base member's front end;

a stabilizer chain having a first end and a second end, said first end being fixed to said chain hook, said second end being fixed to said turnbuckle opposite said roller securing assembly; and an elongated axle member having a first end, a second end, a first wheel, and a second wheel, said axle member being fixed to said base member's bottom surface, said first wheel being movably attached to said first end, said second wheel being movably attached to said second end.

2. The fence dispensing apparatus of claim 1 further comprising:

an elongated hitch extension having a first end and a second end, said first end being fixed to and extending perpendicularly from said base member's front end; and a hitch receptacle, said hitch receptacle being fixed to said hitch extension's second end.

3. The fence dispensing apparatus of claim 1 further comprising:

a first eye plate defining an aperture in the center thereof, said first eye plate extending perpendicularly from said base member's top surface; a pin being shaped and dimensioned for translation through said first eye plate's aperture; and a second eye plate defining an aperture in the center thereof, said second eye plate extending perpendicularly from said base member's top surface; a pin being shaped and dimensioned for translation through said second eye plate's aperture;

said first and second eye plates being positioned for association with a three-point tractor hookup.

4. The fence dispensing apparatus of claim 1 further comprising:

a winch securing assembly having an exterior surface and an interior surface, said winch securing assembly defining a bolt receptacle, said interior surface defining a bore extending through said winch securing assembly, and said bore being shaped and dimensioned for slidable reception of said roller support; a bolt being shaped and dimensioned for threadable translation through said bolt receptacle;

a winch, said winch being fixed to said winch securing assembly;

a cable, said cable having a first end attached to said winch;

a hook, said hook being attached to said cable opposite said winch; and a wire interface having a first end, a second end, a whole loop, a semi loop, and a bridge portion, said first end being integrally attached to said whole loop, said second end being integrally attached to said semi loop, and said bridge portion connecting said first and second ends and defining a plurality of notches therein.

5. The fence dispensing apparatus of claim 1 further comprising:

a second roller having a first end, a second end, an inner plate, an outer plate, said inner plate being fixed to said second roller's first end, said second roller's second end defining a bolt receptacle therein, and said outer plate defining an aperture in its center; a bolt being shaped and dimensioned for threadable translation through said outer plate's aperture and into said roller's bolt receptacle; and a second roller securing assembly having an exterior surface and an interior surface, said second roller securing assembly being fixed to said second roller's inner plate opposite said second roller and defining a bolt receptacle therein, said interior surface defining a bore extending through said second roller securing assembly, and said bore being shaped and dimensioned for slidable reception of said roller support; a bolt being shaped and dimensioned for threadable translation through said bolt receptacle.

6. The fence dispensing apparatus of claim 1 further comprising:

a second roller support having a first end and a second end, said first end being fixed to and extending perpendicularly from said base member's top surface.

7. The fence dispensing apparatus of claim 1 wherein said roller's inner plate defines a notch in its perimeter and said roller's outer plate has a rod receptacle extending perpendicularly from said outer plate's perimeter.

8. The fence dispensing apparatus of claim 7 further comprising:

a rod, said rod being shaped and dimensioned for insertion into said inner plate's notch and said outer plate's rod receptacle; and a safety plate, said safety plate being hingedly attached to said rod.

9. The fence dispensing apparatus of claim 8 further comprising:

a winch securing assembly having an exterior surface and an interior surface, said winch securing assembly defining a bolt receptacle, said interior surface defining a bore extending through said winch securing assembly, and said bore being shaped and dimensioned for slidable reception of said roller support; a bolt being shaped and dimensioned for threadable translation through said bolt receptacle;

a winch, said winch being fixed to said winch securing assembly;

a cable, said cable having a first end attached to said winch; and a hook, said hook being attached to said cable opposite said winch.

10. The fence dispensing apparatus of claim 9 further comprising:

a wire interface having a first end, a second end, a whole loop, a semi loop, and a bridge portion, said first end being integrally attached to said whole loop, said second end being integrally attached to said semi loop, and said bridge portion connecting said first and second ends and defining a plurality of notches therein.

11. The fence dispensing apparatus of claim 10 further comprising:

an elongated hitch extension having a first end and a second end, said first end being fixed to and extending perpendicularly from said base member's front end; and a hitch receptacle, said hitch receptacle being fixed to said hitch extension's second end.

12. The fence dispensing apparatus of claim 11 further comprising:

a first eye plate defining an aperture in the center thereof, said first eye plate extending perpendicularly from said base member's top surface; a pin being shaped and dimensioned for translation through said first eye plate's aperture; and a second eye plate defining an aperture in the center thereof, said second eye plate extending perpendicularly from said base member's top surface; a pin being shaped and dimensioned for translation through said second eye plate's aperture;

said first and second eye plates being positioned for association with a three-point tractor hookup.

13. A fence dispensing apparatus comprising:

a base member having a front end, a back end, a top surface, and a bottom surface;

a spindle receptacle having an exterior surface and an interior surface, said interior surface defining a bore extending through said spindle receptacle, said spindle receptacle being fixed to said base member and extending perpendicularly from said base member's top surface;

a circular-shaped wear plate defining an aperture in the center thereof, said wear plate's aperture being shaped and dimensioned for slidable reception of said spindle receptacle; a plurality bolts directed through said wear plate and said base plate to removably couple the wear plate to the base plate;

an elongated spindle having a first end and a second end, said spindle's first end being shaped and dimensioned for slidable insertion into said spindle receptacle's bore;

a spindle lock having a first end and a second end, said first end being integrally attached to and extending perpendicularly from said spindle's second end, said spindle lock's second end defining an aperture lying in a plane perpendicular to said spindle;

a spindle support having a first end, a second end, said first end being fixed to and extending perpendicularly from said base member's top surface between said wear plate and said base member's front end;

a spindle securing plate having a first end and a second end, said spindle securing plate's first end being rotatably attached to said spindle support's second end, said spindle securing plate's second end defining an aperture lying in a plane perpendicular to said spindle support; a pin being shaped and dimensioned for removable translation through said spindle lock's aperture and said spindle securing plate's aperture;

an elongated axle member having a first end, a second end, a first wheel, and a second wheel, said axle member being fixed to said base member's bottom surface, said first wheel being rotatably attached to said first end, said second wheel being rotatably attached to said second end;

an elongated hitch extension having a first end and a second end, said first end being fixed to and extending perpendicularly from said base member's front end; a hitch receptacle, said hitch receptacle being fixed to said hitch extension's second end; and a first eye plate defining an aperture in the center thereof, said first eye plate extending perpendicularly from said base member's top surface; a pin being shaped and dimensioned for translation through said first eye plate's aperture; a second eye plate defining an aperture in the center thereof, said second eye plate extending perpendicularly from said base member's top surface; a pin being shaped and dimensioned for translation through said second eye plate's aperture; said first and second eye plates being positioned for association with a three-point tractor hookup.

14. The fence dispensing apparatus of claim 13 further comprising:

a second spindle receptacle having an exterior surface and an interior surface, said interior surface defining a bore extending through said second spindle receptacle, said second spindle receptacle being fixed to said base member and extending perpendicularly from said base member's top surface;

a second wear plate defining an aperture in the center thereof, said second wear plate's aperture being shaped and dimensioned for slidable reception of said second spindle receptacle; a plurality bolts directed through said second wear plate and said base plate to removably couple the second wear plate to the base plate.

a second spindle having a first end and a second end, said second spindle's first end being shaped and dimensioned for slidable insertion into said second spindle receptacle's bore;

a second spindle lock having a first end and a second end, said first end being integrally attached to and extending perpendicularly from said second spindle's second end, said second spindle lock's second end defining an aperture lying in a plane perpendicular to said second spindle;

a second spindle support having a first end, a second end, said first end being fixed to and extending perpendicularly from said base member's top surface between said second wear plate and said base member's front end; and a second spindle securing plate having a first end and a second end, said second spindle securing plate's first end being rotatably attached to said second spindle support's second end, said second spindle securing plate's second end defining an aperture lying in a plane perpendicular to said second spindle support; a pin being shaped and dimensioned for removable translation through said second spindle lock's aperture and said second spindle securing plate's aperture.

15. The fence dispensing apparatus of claim 13 further comprising:

an elongated winch support having a first end and a second end, said first end extending perpendicularly from said base member's top surface;

a winch securing assembly having an exterior surface and an interior surface, said winch securing assembly defining a bolt receptacle, said interior surface defining a bore extending through said winch securing assembly, and said bore being shaped and dimensioned for slidable reception of said winch support; a bolt being shaped and dimensioned for threadable translation through said bolt receptacle;

a winch, said winch being fixed to said winch securing assembly;

a cable, said cable having a first end attached to said winch;

a hook, said hook being attached to said cable opposite said winch; and a wire interface having a first end, a second end, a whole loop, a semi loop, and a bridge portion, said first end being integrally attached to said whole loop, said second end being integrally attached to said semi loop, and said bridge portion connecting said first and second ends and defining a plurality of notches therein.

16. A fence dispensing apparatus comprising:

a base member having a front end, a back end, a top surface, and a bottom surface;

a roller support having a first end and a second end, said first end being fixed to and extending perpendicularly from said base member's top surface;

a pipe-shaped roller having a first end, a second end, an inner plate, an outer plate, said inner plate being fixed to said roller's first end, said second end defining a bolt receptacle therein, and said outer plate defining an aperture in its center; a bolt being shaped and dimensioned for threadable translation through said outer plate's aperture and into said roller's bolt receptacle;

a roller securing assembly having an exterior surface and an interior surface, said roller securing assembly being fixed to said roller's inner plate opposite said roller and defining a bolt receptacle, said interior surface defining a bore extending through said roller securing assembly, and said bore being shaped and dimensioned for slidable reception of said roller support; a bolt being shaped and dimensioned for threadable translation through said bolt receptacle; a turnbuckle, said turnbuckle having a first end fixed to said roller securing assembly;

a chain hook fixed to said base member's top surface between said roller support and said base member's front end;

a stabilizer chain having a first end and a second end, said first end being fixed to said chain hook, said second end being fixed to said turnbuckle opposite said roller securing assembly;

an elongated axle member having a first end, a second end, a first wheel, and a second wheel, said axle member being fixed to said base member's bottom surface, said first wheel being rotatably attached to said first end, said second wheel being rotatably attached to said second end;

an elongated hitch extension having a first end and a second end, said first end being fixed to and extending perpendicularly from said base member's front end; a hitch receptacle, said hitch receptacle being fixed to said hitch extension's second end; and a first eye plate defining an aperture in the center thereof, said first eye plate extending perpendicularly from said base member's top surface; a pin being shaped and dimensioned for translation through said first eye plate's aperture; a second eye plate defining an aperture in the center thereof, said second eye plate extending perpendicularly from said base member's top surface; a pin being shaped and dimensioned for translation through said second eye plate's aperture; said first and second eye plates being positioned for association with a three-point tractor hookup.

17. The fence dispensing apparatus of claim 16 wherein said roller's inner plate defines a notch in its perimeter and said roller's outer plate has a rod receptacle extending perpendicularly from said outer plate's perimeter.

18. The fence dispensing apparatus of claim 17 further comprising:

a rod, said rod being shaped and dimensioned for insertion into said inner plate's notch and said outer plate's rod receptacle; and a safety plate, said safety plate being hingedly attached to said rod.

19. The fence dispensing apparatus of claim 18 further comprising:

a winch securing assembly having an exterior surface and an interior surface, said winch securing assembly defining a bolt receptacle, said interior surface defining a bore extending through said winch securing assembly, and said bore being shaped and dimensioned for slidable reception of said roller support; a bolt being shaped and dimensioned for threadable translation through said bolt receptacle;

a winch, said winch being fixed to said winch securing assembly;

a cable, said cable having a first end attached to said winch;

a hook, said hook being attached to said cable opposite said winch; and a wire interface having a first end, a second end, a whole loop, a semi loop, and a bridge portion, said first end being integrally attached to said whole loop, said second end being integrally attached to said semi loop, and said bridge portion connecting said first and second ends and defining a plurality of notches therein.

* * * * *